US009518316B2

(12) United States Patent
Kantereit

(10) Patent No.: US 9,518,316 B2
(45) Date of Patent: Dec. 13, 2016

(54) MOTOR VEHICLE COMPONENT

(71) Applicant: GM GLOBAL TECHNOLOGY OPERATIONS LLC, Detroit, MI (US)

(72) Inventor: Heike Kantereit, Mannheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 35 days.

(21) Appl. No.: 14/604,174

(22) Filed: Jan. 23, 2015

(65) Prior Publication Data

US 2015/0211101 A1 Jul. 30, 2015

(30) Foreign Application Priority Data

Jan. 27, 2014 (DE) ..... 10 2014 000 969

(51) Int. Cl.

| | |
|---|---|
| ***B32B 15/00*** | (2006.01) |
| ***C23C 2/06*** | (2006.01) |
| ***C23C 2/02*** | (2006.01) |

(52) U.S. Cl.

CPC . *C23C 2/06* (2013.01); *C23C 2/02* (2013.01); *Y10T 428/12965* (2015.01)

(58) Field of Classification Search

None

See application file for complete search history.

(56) References Cited

U.S. PATENT DOCUMENTS

| | | | | |
|---|---|---|---|---|
| 3,865,638 | A * | 2/1975 | Ballantyne | C21D 3/04 148/629 |
| 6,902,829 | B2 * | 6/2005 | Pradhan | B32B 15/013 148/533 |
| 8,980,017 | B2 * | 3/2015 | Sasaki | C23C 8/02 148/278 |
| 2014/0020795 | A1 | 1/2014 | Schwinghammer et al. | |
| 2015/0017469 | A1 | 1/2015 | Sauer et al. | |

FOREIGN PATENT DOCUMENTS

| | | | |
|---|---|---|---|
| DE | 202004021264 | U1 | 5/2007 |
| DE | 102010056264 | B4 | 12/2012 |
| DE | 102011053939 | A1 | 3/2013 |
| WO | 2015005191 | A1 | 1/2015 |
| WO | WO2015005191 | * | 1/2015 |

OTHER PUBLICATIONS

DPMA, German Search Report for Application No. 102014000969.6, dated Mar. 12, 2014.

Great Britain Patent Office, Great Britain Search Report for Great Britain Application No. 1422327.5, dated Oct. 16, 2015.

* cited by examiner

*Primary Examiner* — Daniel J Schleis

(74) *Attorney, Agent, or Firm* — Lorenz & Kopf LLP

(57) ABSTRACT

A motor vehicle component, in particular body component, is disclosed in which a steel sheet has a corrosion protection coating arranged thereon. The steel sheet has a core with more than 90% of Martensite and an exterior zone with less than 90% Martensite. The corrosion protection coating is arranged on the exterior zone. A depth of this exterior zone amounts to at least 5 μm and/or at least 0.5% of a wall thickness of the steel sheet.

6 Claims, 1 Drawing Sheet

MOTOR VEHICLE COMPONENT

CROSS REFERENCE TO RELATED APPLICATION

This application claims priority to German Patent Application No. 102014000969.6 filed Jan. 27, 2014, which is incorporated herein by reference in its entirety.

TECHNICAL FIELD

The present disclosure relates to a motor vehicle component, in particular a body component, with a steel sheet on which a corrosion protection coating is arranged, and to a motor vehicle, in particular a passenger car having such a motor vehicle component and to a method for producing such a motor vehicle component.

BACKGROUND

DE 20 2004 021 264 U1 discloses a hardened steel sheet with a corrosion protection layer, during the production of which initially electrolytic or dip galvanizing and subsequently hardening initially takes place. During the hot forming of such a steel sheet, cracks in the corrosion protection layer can develop which can disadvantageously continue into the hardened steel sheet.

SUMMARY

In accordance with the present disclosure, a motor vehicle component is provided having a steel sheet on which a corrosion protection coating is arranged. The steel sheet includes a core with more than 90% of Martensite. An exterior zone with less than 90% of Martensite includes a corrosion protection coating. The depth of the exterior zone amounts to at least 5 μm and/or at least 0.5% of a wall thickness of the steel sheet (10).

According to an aspect of the present disclosure, a motor vehicle component, in particular a component or element of a body of a motor vehicle, in particular of a passenger car, includes a steel sheet. In an embodiment, the steel sheet includes a manganese and/or borum-containing alloy.

According to an embodiment, a one or multi-layered corrosion protection coating is arranged on the steel sheet. In a further development, this can include an alloying component of at least 50% by volume or weight; in particular at least 75% by volume or weigh; preferentially at least 90% by volume or weight of a metal which compared with iron (Fe) is electrochemically more ignoble. The metal can in particular be zinc (Zn) or magnesium (Mg). By a corrosion protection coating having an electrochemically more ignoble alloying component, cathodic corrosion protection can be advantageously realized in an embodiment.

In an embodiment, the corrosion protection coating can be formed as hot dip coating. The component may in particular be a hot dip galvanized steel sheet or the steel sheet may be hot dip galvanized. In another embodiment, the corrosion protection coating can be formed electrolytically or by means of deposition of a coating from an electrolyte subject to the passage of current.

According to an aspect of the present disclosure, the steel sheet, in particular after the hardening for example by means of hot forming, has a core with more than 90% by volume or weight, in particular more than 95% by volume or weight, Martensite or Martensitic structure and an exterior zone with less than 90% by volume or weight, in particular less than 95% by volume or weight of Martensite or Martensitic structure, on which the corrosion protection coating is arranged. The depth of this exterior zone, whether a minimal, maximal or averaged depth, amounts to at least 5 μm, in particular at least 10 μm and/or at least 0.5%, in particular at least 1% of an wall thickness of the steel sheet, whether minimal, maximal or averaged wall thickness. In an embodiment, the exterior zone covers the core on one or both sides. The exterior zone can in particular, enclose the core. In a further development, the exterior zone is formed continuously or closed on one or both sides of the core, in particular, the exterior zone can be arranged everywhere between core and corrosion protection coating.

In an embodiment, by such a Martensite-poorer exterior zone and such a martensite-richer core, a relatively harder core and an exterior zone or layer or (outer) shell of adequate depth that is relatively softer compared with the core is provided, on which the corrosion protection coating is arranged. It has come to light that by a softer outer shell of adequate depth in an embodiment crack propagation or continuation out of the corrosion protection coating into the core can be advantageously reduced, preferentially and/or prevented.

In an embodiment, the depth of the exterior zone amounts to at most 60 μm and in particular at most 50 μm; and/or at most 6% and in particular at most 5% of the wall thickness of the steel sheet. Because of this, an advantageous boundary layer can be formed within the steel sheet in an embodiment.

A Martensite-poorer exterior zone can be achieved in an embodiment by a corresponding process control during the hardening of the steel sheet before and after the arranging of the corrosion protection coating, in particular by a sufficiently low cooling speed and/or subsequent annealing or tempering. However, this is difficult to achieve upon hardening by means of hot forming. For this reason, the exterior zone is produced or formed by specific decarburization of the edge of the steel sheet. Accordingly, in an embodiment, the exterior zone is a decarburized zone with a carbon content amounting to maximally 95%, in particular maximally 90% of a carbon content of the core.

As explained above, a Martensite-poorer exterior zone can be produced by a corresponding process control during the hardening of the steel sheet, in particular by means of hot forming, which can advantageously shorten the production time. In the embodiment explained above with prior decarburizing of the steel sheet, the corrosion protection layer is preferably subsequently arranged on the steel sheet or its exterior zone and the steel sheet with the corrosion protection coating arranged thereon or the motor vehicle component including the corrosion protection coating, hardened, in particular hardened and tempered. In a further development the heating for hardening, in particular for converting ferrite into austenite, is carried out by means of hot forming the motor vehicle component.

According to an aspect of the present disclosure, the exterior zone of the steel sheet is produced in particular before the corrosion protection coating is arranged on the steel sheet, in particular by initially specifically decarburizing the steel sheet on its surface and subsequently applying the corrosion protection coating. In a further development, the corrosion protection coating is arranged on the steel sheet and subsequently the motor vehicle component hardened, in particular hardened and tempered, wherein the motor vehicle component can be hardened, in particular hardened and tempered by means of hot forming. As used herein the term "subsequently" mean in particular following in time or in the process sequence, wherein between a process step, in particular the decarburizing and a subsequent process step, in particular the arranging of the corrosion protection coating and/or the hardening, one or multiple further process steps can be carried out, and a subsequent process step can thus be carried out in particular indirectly or directly after a preceding process step.

In an embodiment, the steel sheet is decarburized by means of ammonia crack gas by heating, in particular annealing in order to produce the exterior zone.

BRIEF DESCRIPTION OF THE DRAWINGS

The present disclosure will hereinafter be described in conjunction with the following drawing figures, wherein like numerals denote like elements. The figures illustrate a body component at various steps of its production according to an embodiment of the present disclosure as follow.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
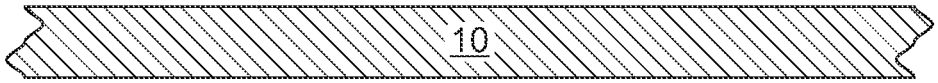
FIG. 1 shows a manganese-boron-alloyed steel sheet in the form of a starting semi-finished product.

FIG. 1 shows a manganese-boron-alloyed steel sheet 10 in the form of a starting semi-finished product, for example in a rolling process.

Figure 2:
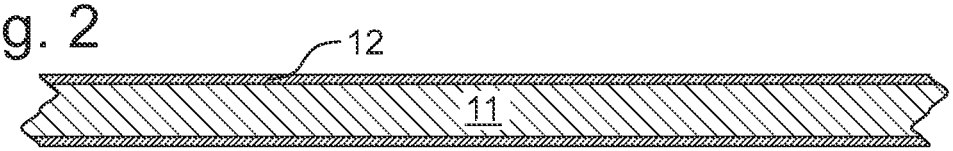
FIG. 2 shows the steel sheet having an inner core and an peripheral layer or exterior zone surrounding the inner core.

By actively decarburizing, a peripheral layer 12 of the steel sheet 10 is specifically decarburized or its carbon content reduced compared to an inner core 11 of the steel sheet 10, as is shown in the figure sequence FIG. 1 to FIG. 2 in order to form an exterior zone 12 which surrounds the core 11.

Figure 3:
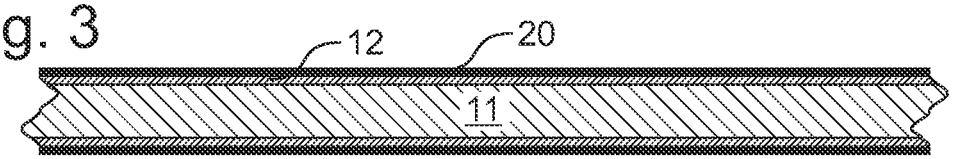
FIG. 3 shows the steel sheet with a corrosion protection coating over the peripheral layer.

Following this, a corrosion protection coating 20 is arranged on the exterior zone 12 of the steel sheet 10 for example by electrolytic or hot dip galvanizing as shown in the figure sequence from FIG. 2 to FIG. 3.

Figure 4:
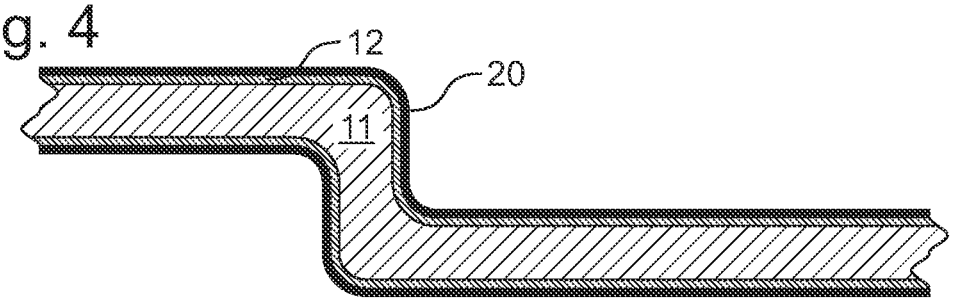
FIG. 4 shows a formed steel sheet for which the corrosion protection coating is hardened and tempered.

Following this, the steel sheet 10 with the corrosion protection coating 20 arranged thereon is hardened and tempered as shown in the figure sequence FIG. 3 to FIG. 4. Because of the preceding decarburization of the peripheral layer more than 95% of martensitic structure is obtained in the core 11 and in the exterior zone 12 with a depth between 10 and 50 μm, less than 95% of martensitic structure. W in FIG. 2 indicates the wall thickness of the steel sheet.

Crack formation and prorogation out of the corrosion protection coating 20 into the core 11 can thereby be advantageously reduced, preferentially prevented.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A motor vehicle component comprising a steel sheet having:

a core with more than 90% of Martensite, an exterior zone with less than 90% of Martensite, and a corrosion protection coating arranged on the exterior zone, wherein a depth of the exterior zone is in a range between 5 μm and 6 μm or between 0.5% and 0.6% of a wall thickness of the steel sheet.

2. The motor vehicle component according to claim 1, wherein the exterior zone comprises a decarburized zone with a carbon content which is no greater than 90% of a carbon content of the core.

3. The motor vehicle component according to claim 1, wherein the corrosion protection coating comprises an alloying component of at least 50% of a metal, by volume or by weight, which compared with iron is electrochemically more ignoble.

4. The motor vehicle component according to claim 3 wherein the alloying component is selected from the group consisting of a zinc-based alloying component and a magnesium-based alloying component.

5. The motor vehicle component according to claim 1, wherein the motor vehicle component with the corrosion protection coating is hardened.

6. The motor vehicle component according to claim 5, wherein the motor vehicle component is hardened and tempered.

* * * * *